US006345735B1

(12) United States Patent
Harvey et al.

(10) Patent No.: US 6,345,735 B1
(45) Date of Patent: Feb. 12, 2002

(54) BEVERAGE DISPENSER

(75) Inventors: David Harvey, Kinross; Duncan Murray, Edinburgh; Jon Brown, West Linton; George Wallen, West Lothian, all of (GB)

(73) Assignee: Scottish & Newcastle PLC (GB)

( * ) Notice: Subject to any disclaimer, the term of this patent is extended or adjusted under 35 U.S.C. 154(b) by 0 days.

(21) Appl. No.: 09/660,262

(22) Filed: Sep. 12, 2000

(30) Foreign Application Priority Data

Mar. 10, 2000 (GB) ..... 0005917

(51) Int. Cl.[7] ..... B67D 5/58
(52) U.S. Cl. ..... 222/190; 222/547; 222/564
(58) Field of Search ..... 222/190, 331, 222/486, 482, 564, 547

(56) References Cited

U.S. PATENT DOCUMENTS 4,742,942 A * 5/1988 Dokos et al. ..... 222/547
5,368,205 A * 11/1994 Groh ..... 222/547

FOREIGN PATENT DOCUMENTS

| | | | | |
|---|---|---|---|---|
| BE | 1 002 752 A | | 5/1991 | |
| GB | 2176766 | * | 1/1987 | ..... 222/190 |
| GB | 2 326 633 | | 12/1998 | |
| JP | 2- 152 692 | | 6/1990 | |

OTHER PUBLICATIONS

English Language Abstract for JP Application No. JP 1988000 304410 to Gomi Katsuji, published Jun. 12, 1990.

* cited by examiner

*Primary Examiner*—Philippe Derakshani
(74) *Attorney, Agent, or Firm*—Smith, Gambrell & Russel LLP

(57) ABSTRACT

An apparatus for dispensing a beverage into a receptacle is provided having one or more taps, between them defining two beverage flow paths. One of the beverage flow paths is provided with a flow restriction for inducing turbulence in the beverage flow for producing foam. An arrangement is provided for directing the beverage flow path subjected to the turbulence inducing flow restriction to be not vertically orientated at an outlet such that fobbing of the beverage in the receptacle is prevented.

25 Claims, 2 Drawing Sheets

BEVERAGE DISPENSER

FIELD OF THE INVENTION

This invention relates to improvements in or relating to dispensing apparatus. In particular, the invention relates to the dispensing of beverages, for example, beer, ale, porter, stout or lager. The present invention finds particular application for use in dispensing draft beverages where the beverage is stored in a keg or similar container and is transported to a dispensing tap as and when required.

BACKGROUND OF THE INVENTION

It is common to provide a tap, or other such device, at the point of dispensation of the beverage to allow a user to control the quantity and timing of dispensation of the beverage. Such taps are normally manually operated. It is also known to dispense beverages containing a gas such as carbon dioxide and/or nitrogen in solution in such a way as to produce a close-knit, creamy head on the beverage. Typical examples of such beverages are stouts and ales. The creamy head has been found to have a pleasing aesthetic effect. A creamy head may be produced on some beverages by providing a fixed orifice plate or a suitable agitation means within the flow path of the tap. The orifice tap comprises a disc-shaped partition disposed substantially perpendicularly to the flow path of the beverage. The partition has a number of apertures through which beverage passes. The reduced size of the apertures in the orifice plate compared to the tap as a whole acts as a restriction on the flow path and induces turbulence to the flow of beverage, leading to nucleation of bubbles of gas dissolved in the beverage. These bubbles grow and nucleate further bubbles as the beverage is dispensed into a receptacle such as a glass. As the beverage settles after dispensing, the bubbles rise to form a close-knit, creamy head.

A disadvantage with orifice plates is that all of the beverage passes through the orifice plate. With some beverages (those containing more than 2.5 g/l $CO_2$), this leads to the nucleation of too many bubbles which results in over-foaming of the beverage (known as fobbing), which is undesired. Given that nearly all lagers and most keg ales have a greater than 2.5 g/l $CO_2$ dissolved in them, a large number of products are incapable of being dispensed with a creamy head with their current $CO_2$ levels. Factors which affect the degree of fobbing include the temperature, $CO_2$ (or other) gas pressure and the flow speed of the beverage. Reducing the temperature, gas pressure and/or flow speed can reduce the degree of fobbing but this can be expensive and reduces customers' acceptance of the beverage in other areas.

Our co-pending application, GB 9900727 discloses a dispensing apparatus as shown in FIG. 1. The dispensing apparatus is in the form of a tap having a spout which comprises a portion 2*a* of a relatively narrow diameter and a portion 2*b* of a relatively large diameter. One end of the tap is connected to a beverage line and the other end terminates in an outlet through which the beverage is dispensed. A vertical partition 3 is positioned within portion 2*b* of the spout extending across the full diameter of the spout to divide the portion 2*b* into two chambers 14 and 15. An orifice plate 10 is provided in chamber 14 extending between partition 3 and a side wall of portion 2*b* of the spout. There is no orifice plate positioned in chamber 15. A flap valve 16 is rotatably mounted on a hinge 17 at an upper end of the vertical partition 3 is provided to act as an inlet valve. The flap valve 16 and hinge 17 arrangement is preferably operatively connected to a handle on the tap. The flap valve 16 may be rotated from the position shown in solid lines in FIG. 1 in which the inlet to chamber 15 is closed and beverage is constrained to flow through chamber 14 along the path indicated by arrow 13*a*, to a second position shown in dotted lines in FIG. 1, in which the inlet to chamber 14 is closed and beverage is constrained to flow through chamber 15 following the path of arrow 13*b*. The orifice plate 10 contains one or more apertures 18.

In use, flap valve 16 is initially in the second position shown in dotted lines in FIG. 1 such that the inlet to chamber 15 is open and chamber 14 is closed. A handle of the tap is then operated to discharge beverage through chamber 15 into a receptacle, such as a glass. At the appropriate time, the handle operatively connected to flap valve 16 is operated to move flap valve 16 into its first position shown in solid lines in FIG. 1 such that the beverage flow is diverted through chamber 14 and hence through orifice plate 10 where gas bubbles are nucleated. As a result, a creamy head is designed to be deposited on the beverage.

It has been found that use of the above described apparatus of FIG. 1 is problematic. In particular, the beverage diverted through chamber 14 which is foamed as it passes through orifice plate 10 is dispensed into the receptacle at a relatively high speed. This has been found to cause unacceptable levels of fobbing of the beverage.

SUMMARY OF THE INVENTION

It is an object of the present invention to provide a dispensing apparatus which at least overcomes this problem.

According to the present invention, there is provided dispensing apparatus for dispensing a beverage into a receptacle comprising one or more taps between them defining two beverage flow paths, wherein one of the beverage flow paths are provided with a flow restriction for inducing turbulence in the beverage flow for producing foam and means for directing said beverage flow path to be not vertically orientated at an outlet such that fobbing of beverage in the receptacle is prevented.

There is also disclosed a method of dispensing a beverage into a receptacle comprising the steps of dispensing beverage through a first tap or chamber into the receptacle, subsequently dispensing beverage through a second tap or chamber containing a flow restriction for inducing turbulence in the beverage flow for producing foam and directing said foam into the receptacle in a non-vertical direction.

BRIEF DESCRIPTION OF THE DRAWINGS

Embodiments of the present invention will now be described, by way of example only, with reference to the following drawings, in which.

DETAILED DESCRIPTION OF THE PREFERRED EMBODIMENTS

Figure 1:
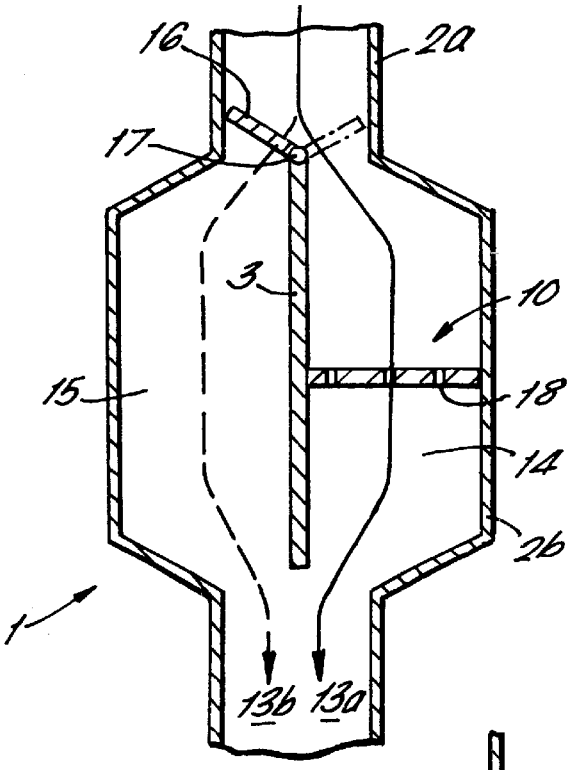
FIG. 1 is a cross-sectional side elevation of a dispensing apparatus disclosed in co-pending application GB 9900727.
Figure 2:
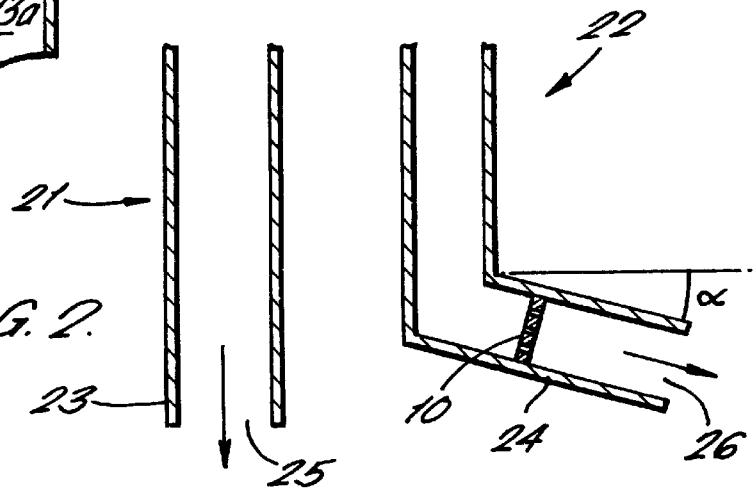
FIG. 2 is a schematic representation of a first embodiment of dispensing apparatus according to the present invention.

FIG. 2 shows a first embodiment of apparatus 1 according to the present invention in which first and second taps 21, 22 are provided having spouts 23, 24. The taps may be mounted in a font (not shown) which may in turn be mounted on a bar top or similar surface. Each tap 21, 22 has a separate handle associated with it for controlling the flow of beverage. Alternatively, electronic control means may replace one or both of the handles.

Each tap comprises, amongst other parts, a valve for opening and closing the tap, a handle (or electronic control) for operating the valve moveable from a closed position in which the valve is closed and beverage flow is prevented to an open position in which the valve is open to allow a flow of beverage, and means for connecting the tap to a beverage line. Typically, each spout 23, 24 comprises a hollow cylindrical housing connected upstream to a beverage line through which beverage is conveyed from a storage point. Both taps 21, 22 may be connected to the same beverage line. Alternatively, a single beverage line may be used to convey the beverage from the storage point towards the font. In this case the beverage line is split just before entering the font into two branches, with each branch supplying a different tap 21, 22.

Each spout 23, 24 terminates in an outlet 25, 26 through which the beverage is dispensed.

The spout 23 of the first tap 21 is orientated substantially vertically or at only a small angle from the vertical. The spout 24 of the second tap 22 is orientated at an angle $\alpha$ to the horizontal such that it is not vertical.

The second tap 22 is provided with an orifice plate 10 which may be positioned at any point within the spout 24. In particular, the orifice plate 10 may be positioned relatively near the outlet 26 of the spout 24 or relatively far from the outlet 26.

The orifice plate 10 is fixedly located in the spout 24 and orientated generally perpendicularly to the direction of flow of the beverage passing therethrough. The orifice plate 10 includes one or more apertures. The number, position and shape of the apertures may be varied as is known in the art.

First tap 21 does not contain an orifice plate.

In use, the handle of the first tap 21 (or the electronic control means) is moved from its closed to its open position to discharge beverage through spout 23 into a receptacle 20, such as a glass. Since no orifice plate is provided in spout 23, the flow of beverage is substantially laminar and without significant turbulence. Consequently, the beverage is dispensed without a head being formed. At an appropriate time, the handle of the first tap 21 is closed and the receptacle 20 is moved to beneath the outlet 26 of the second tap 22. The handle of the second tap 22 is then operated to open the valve of the second tap 22 to dispense a further quantity of beverage into the receptacle 20. Beverage dispensed through the second tap 22 passes through orifice plate 10 wherein, given its high $CO_2$ content, it is forced to flow turbulently resulting in nucleation of gas bubbles and the delivery of foam onto the top of the beverage to form a creamy head. The ratio of liquid to foam dispensed from the second tap 22 may be varied by, for example, varying the temperature of the beverage supplied to the second tap 22. The higher the temperature of the beverage, the more foam will be produced. At one extreme only foam and no liquid may be dispensed from the second tap 22. This may be advantageously achieved where the beverage supply line is split into two branches just before entering the font by leaving the branch supplying the second tap 22 uninsulated. In this way the temperature of the beverage flowing through the branch will increase. Alternatively separate heating means may be provided.

Angle $\alpha$ may be varied with some freedom so long as beverage and/or foam dispensed from outlet 26 does not cause fobbing of the beverage in the receptacle. Preferably angle $\alpha$ is close to zero. However an angle $\alpha$ of greater than zero will also produce a beneficial effect. For example angle $\alpha$ may be varied between 0 and 45 degrees. Due to the low angle $\alpha$ of inclination of the second spout 24, the creamy head of foam and/or beverage is dispensed into the receptacle 20 at a relatively slow speed and such that the creamy head does not impact the beverage in the receptacle at an angle substantially normal to the surface of the beverage. The geometry of the impact and the reduced density of the foam and/or beverage of the creamy head compared to the beverage result in the creamy head having a much reduced vertical component of momentum. These factors help to significantly reduce the degree of disturbance (and hence fobbing) imparted to the beverage in the receptacle. This is the case even where the second tap 22 is connected to a beverage delivery line at normal working pressure. As a result, the addition of the creamy head does not have a tendency to fob the beverage already in the receptacle 20.

It has been found that the colder the beverage in the receptacle 20 the longer the $CO_2$ in the beverage will be retained in solution rather than rising to the surface of the beverage where it contacts the creamy head with a detrimental effect. Beverages such as lagers are typically dispensed at approximately 7 degrees centigrade. According to the present invention the beverage dispensed through the first tap 21 is preferably dispensed at between 0 and 7 degrees centigrade. In contrast the beverage dispensed through the second tap 22 is preferably dispensed at between 7 degrees centigrade and any where up to ambient so as to maximise the amount of foam produced by the orifice plate 10. As described above this may be achieved by leaving a portion of the beverage supply line to the second tap 22 uninsulated.

Figure 3:
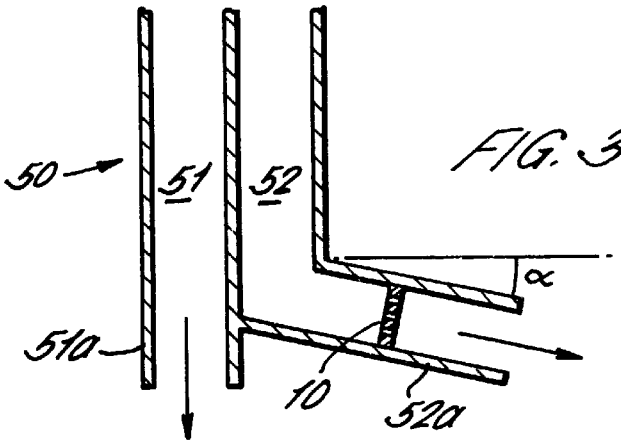
FIG. 3 is a schematic representation of a second embodiment of dispensing apparatus according to the present invention.

FIG. 3 shows a second embodiment in which the first and second taps 21, 22 of the first embodiment have been formed into a single tap 50 having first and second chambers 51, 52 connected to separate beverage supply lines or to a single beverage line which splits into two branched as described above with reference to the first embodiment. First chamber 51 has an outlet spout 51*a* which is substantially vertical whereas chamber 52 has an outlet spout 52*a* which is inclined at an angle $\alpha$ to the horizontal as described above with reference to the first embodiment.

Second chamber 52 contains an orifice plate 10 whilst first chamber 51 does not. Each chamber 51, 52 may have a separate handle associated with it for controlling the flow of beverage. Alternatively one handle may be provided for operating both beverage flows, for example, by providing a handle which is pivotable in two directions, each direction being associated with a separate chamber. Electronic controls may alternatively be used.

In use the second embodiment functions in a similar manner to the first embodiment.

Figure 4:
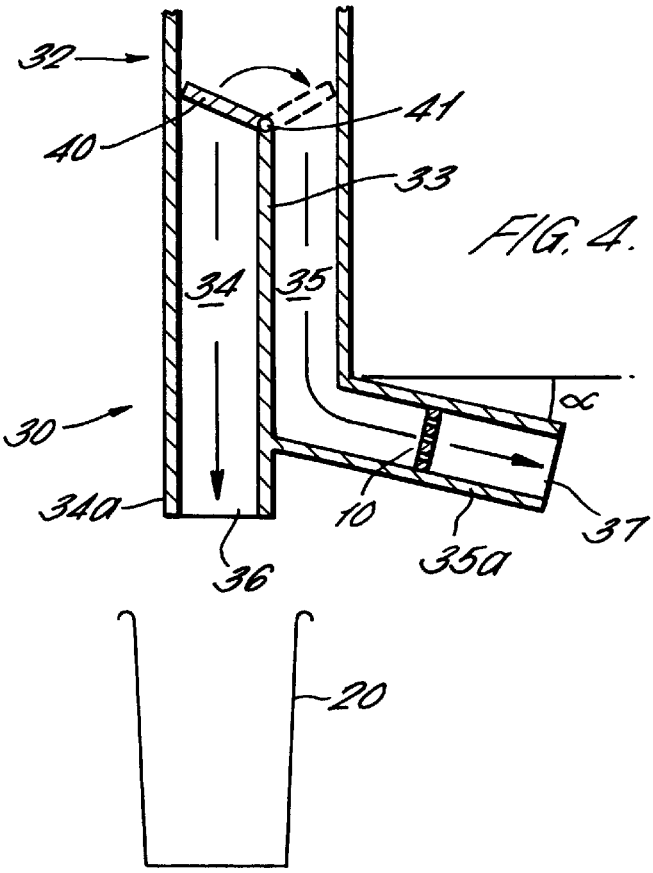
FIG. 4 is a schematic representation of a third embodiment of dispensing apparatus according to the present invention.

FIG. 4 shows a third embodiment in which a single tap 30 is provided having a spout 32 and a vertical partition 33 positioned therein which extends across the full diameter of the spout 32 to divide the spout 32 into two chambers 34 and 35.

Chamber 34 is provided with a substantially vertically orientated spout 34*a* having an outlet 36. Chamber 35 is provided with a spout 35*a* having an outlet 37 which is inclined at an angle $\alpha$ to the horizontal as described above with reference to the first embodiment.

Chamber 35 is provided with an orifice plate 10 substantially similar to the orifice plate 10 described in the first embodiment. Chamber 34 does not contain an orifice plate.

A flap valve 40 or other similar valve means is provided rotatably mounted on a hinge 41 at an upper end of vertical partition 33 to act as a flow control valve. The flap valve 41 may be rotated from the position shown in dotted lines in FIG. 4 in which the inlet to chamber 35 is closed and beverage is constrained to flow through chamber 34 along the path indicated by arrow A, to a second position shown in solid lines in FIG. 4 in which the inlet to chamber 34 is closed and beverage is constrained to flow through chamber 34 following the path of arrow B.

The flap valve 40 and hinge 41 arrangement may be connected to a manual handle or to an electronic control such as a push button to control rotation of the flap valve 40. In the latter case drive means are provided to move the flap valve 40.

In use, the flap valve 40 is normally in the position shown in dotted lines in FIG. 4 such that when the handle of the tap 30 is operated beverage is dispensed into receptacle 20 via chamber 34 in a non-turbulent manner such that no head is formed.

At an appropriate time, the handle or electronic control associated with the flap valve 40 is operated to rotate the flap valve 40 into the position shown in solid lines in FIG. 4 such that the beverage flows through chamber 35 and through orifice plate 10 as described above with reference to the first embodiment.

Figure 5:
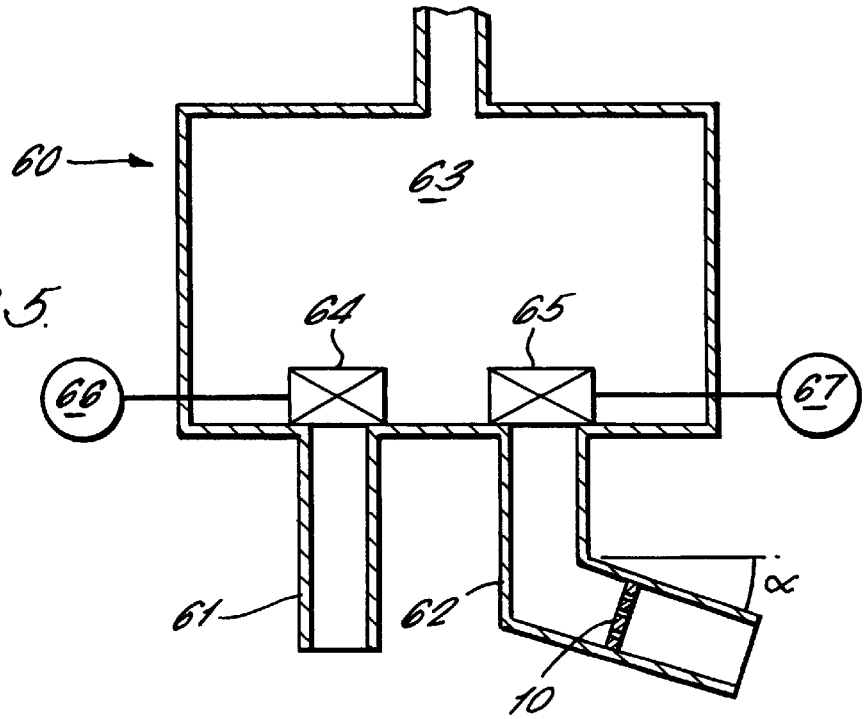
FIG. 5 is a schematic representation of a fourth embodiment of dispensing apparatus according to the present invention.

FIG. 5 shows a fourth embodiment which is similar to the third embodiment wherein a single tap 60 is provided having two spouts 61, 62 fed from a single beverage supply line. Spouts 61, 62 are fed from a common reservoir 63 which is supplied by the beverage supply line. Valve means 64, 65 are provided associated with each spout 61, 62 to control flow of beverage therethrough. Spout 62 is provided with an orifice plate 10 as previously described. Handles 66, 67 or alternatively electronic controls are provided to operate the valve means 64, 65.

The operation of the fourth embodiment is the same as the operation of the second embodiment as described above.

In the above embodiments the taps and/or spouts may be positioned such that the receptacle 20 must be physically moved between the two dispensing steps of dispensing through the first tap or spout and dispensing through the second tap or spout. Alternatively the taps and/or spouts may be positioned such that both dispensing steps may be performed without the need to move the receptacle 20 by positioning the outlets close enough to one another that they both overlie the receptacle 20 at the same time.

Whilst the present invention has been described in particular for use in dispensing ales, lagers and the like it may also be used to dispense a creamy head onto other beverages which are not normally capable of being presented with a foamy head lasting more than a few seconds such as, but not limited to, water, cider, spirits, and spirits mixed with either fruit juices or fruit flavourings. In these cases the foamed creamy head may be formed from the main beverage or may be formed from a separate beverage such as an ale or lager.

The quality and appearance of the creamy head can be improved by increasing the nitrogen gas content of the dispensed beverage, since the nitrogen gas forms smaller, more tightly arranged bubbles than carbon dioxide which tend to last longer before dissipating. This may be achieved by nitrogenating the beverage at the point of manufacture or by dispensing the beverage using a mixed gas supply of carbon dioxide and nitrogen gases.

What is claimed is:

1. Dispensing apparatus for dispensing a beverage into a receptacle comprising one or more taps between them defining two beverage flow paths, wherein one of the beverage flow paths is provided with a flow restriction for inducing turbulence in the beverage flow for producing foam and means for directing said beverage flow path to be not vertically orientated at an outlet such that fobbing of beverage in the receptacle is prevented.

2. Dispensing apparatus as claimed in claim 1, wherein the means directs the beverage flow path between 0 and 60 degrees to the horizontal.

3. Dispensing apparatus as claimed in claim 1, wherein the means directs the beverage flow path to be substantially horizontal.

4. Dispensing apparatus as claimed in claim 1, wherein two taps are provided, each defining one of the beverage flow paths.

5. Dispensing apparatus as claimed in claim 1, wherein a single tap is provided comprising a housing comprising two chambers defining the two beverage flow paths.

6. Dispensing apparatus as claimed in claim 4, wherein the two taps or two chambers are supplied with beverage from a single beverage supply line which comprises two branches, each branch supplying a separate tap or chamber.

7. Dispensing apparatus as claimed in claim 6, wherein one of the branches is provided with means for raising the temperature of beverage flowing therethrough compared to the other branch.

8. Dispensing apparatus as claimed in claim 5, wherein a valve is provided upstream of the chambers movable from a first position in which an inlet to the chamber containing the flow restriction is closed and an inlet to the other chamber is open, to a second position in which the inlet to the chamber containing the flow restriction is open and the inlet to the other chamber is closed.

9. Dispensing apparatus as claimed in claim 8 further comprising a handle associated with said valve.

10. Dispensing apparatus as claimed in claim 8 further comprising an electronic control associated with said valve.

11. Dispensing apparatus as claimed in claim 1, wherein said flow restriction is an orifice plate.

12. Dispensing apparatus as claimed in claim 1, wherein the means directs the beverage flow path between 0 and 45 degrees to the horizontal.

13. Dispensing apparatus as claimed in claim 4 wherein the two taps define different outlet flow path directions.

14. Dispensing apparatus as claimed in claim 13 wherein one of the flow path directions is vertical.

15. Dispensing apparatus as claimed in claim 5 wherein the two chambers define different outlet flow path directions.

16. Dispensing apparatus as claimed in claim 15 wherein one of the flow path directions is vertical.

17. A method of dispensing a beverage into a receptacle comprising the steps of dispensing beverage through a first tap or chamber into the receptacle, subsequently dispensing beverage through a second tap or chamber containing a flow restriction for inducing turbulence in the beverage flow for producing foam and directing said foam into the receptacle in a non-vertical direction.

18. A method as claimed in claim 17, wherein the foam is directed into the receptacle at an angle of between 0 and 60 degrees to the horizontal.

19. A method as claimed in claim 18, wherein the foam is directed into the receptacle substantially horizontally.

20. A method as claimed in claim 17, wherein the temperature of the beverage dispensed through the first chamber or tap is between 0 and 7 degrees centigrade and the temperature of the beverage dispensed through the second tap or chamber is between 7 degrees centigrade and ambient.

21. A method as claimed in claim 17, where the beverage is dispensed using a mixture of carbon dioxide and nitrogen gases.

22. A method as claimed in claim 17, wherein the foam is directed into the receptacle between 0 and 45 degrees.

23. A method as claimed in claim 17 wherein dispensing the beverage though said first tap or chamber and said second tap or chamber is carried out without moving the receptacle.

24. A method as claimed in claim 17 wherein dispensing from said first tap or chamber and said second tap or chamber is carried out so as to produce different outlet flow path directions.

25. A method as claimed in claim 24 wherein one of said outlet flow path directions is vertical.

* * * * *